United States Patent [19]

Grabovac

[11] 4,207,783

[45] Jun. 17, 1980

[54] TORQUE WRENCH

[75] Inventor: Bosko Grabovac, Mission Viejo, Calif.

[73] Assignee: Consolidated Devices Inc., Industry, Calif.

[21] Appl. No.: 896,342

[22] Filed: Apr. 14, 1978

[51] Int. Cl.[2] ..... B25B 23/14

[52] U.S. Cl. ..... 81/52.5

[58] Field of Search ..... 81/52.4 R, 52.5

[56] References Cited

U.S. PATENT DOCUMENTS

| | | | |
|---|---|---|---|
| 3,581,606 | 6/1971 | Grabovac | 81/52.4 R |
| 3,772,942 | 11/1973 | Grabovac | 81/52.5 |
| 3,890,859 | 6/1975 | Grabovac et al. | 81/52.4 R |

*Primary Examiner*—James L. Jones, Jr.
*Attorney, Agent, or Firm*—Georges A. Maxwell

[57] ABSTRACT

An adjustable torque wrench including an elongate tubular lever arm, a work-engaging head at the front end of the arm, an elongate adjustable screw within and accessible at the rear end of the arm, a polygonal driver carried by the screw within the arm, a hand grip with a front section fixed about the arm and a rear section normally adjacent the rear end of said front section and rear end of the arm, an elongate drive sleeve on and projecting forwardly from the rear section into the arm and about the driver; said sleeve has a cylindrical opening in its rear portion to normally freely accommodate the driver and a polygonal opening in its front portion to establish driving engagement with said driver when the rear section is moved rearwardly; said rear section has a forwardly projecting annular skirt with circumferentially spaced axially extending grooves; said front section has a rear extension with circumferentially spaced axially extending ribs normally engaged in the skirt and the grooves; the rear end of the arm projects rearward from the front section to define an annular reference edge and carries circumferentially spaced calibrations; said sleeve has a portion which is exposed and visible adjacent the rear end of the arm when it is moved rearwardly from its normal position, said visible portion of the sleeve carries a longitudinal reference line and longitudinally spaced circumferential calibrations which cooperate with the rear end of the arm to indicate the longitudinal position of the screw relative to the arm when the rear section is in its rearmost position.

4 Claims, 9 Drawing Figures

TORQUE WRENCH

This invention has to do with an adjustable torque wrench and is more particularly concerned with a torque wrench having novel manually operable adjusting means.

In the art of torque wrenches, there are a number of different types of classes of torque wrenches. That type of torque wrench with which the present invention is concerned is the adjustable click-type wrench. Click-type wrenches commonly include an elongate tubular lever arm with front and rear ends, a work-engaging head with an elongate pivot beam pivotally carried by the front end of the lever arm with the beam extending longitudinally rearwardly therein. The rear end of the beam in such wrenches has a rearwardly disposed seat in spaced opposing relationship with a forwardly disposed seat on an axially shiftable plunger within the arm. A cam block with flat oppositely disposed faces is arranged between the seats with its faces normally establishing flat bearing engagement with said seats. An elongate compression spring is arranged within the arm to engage and normally yield the plunger forward. Under the application of torsional forces in and through the head which tends to pivot the beam, the cam block will rock upon the application of predetermined forces therethrough. When the block rocks, the beam pivots laterally and strikes the interior surface of the arm, transmitting an audible click-like signal which advises the operator that the desired or set torsional force has been applied through the wrench and into the work with which the wrench is related.

The force or applied torque which results in the cam block pivoting and the beam on the head striking the interior of the arm, is dependent upon the force exerted by the spring and is adjusted and set, as desired, by adjusting the force exerted axially forwardly by the spring onto the plunger. The basic means provided to adjust the spring in this type of wrench structure includes an axially shiftable block or follower in the body engaging the rear end of the spring and an elongate axially shiftable adjusting scew carried by the arm to extend axially therethrough and engaging the rear end of the follower. By shifting the screw axially within and relative to the arm, the follower is shifted axially therein and the extent to which the spring is compressed or biased axially between the follower and the plunger is varied, as circumstances require.

In order that the spring in the type of wrench here concerned with can be adjusted and set so that the wrench will operate or click when known, predetermined torsional forces are applied to related work by the wrench, calibrated indicating means are related to the arm and to the adjusting screw to indicate the extent to which the spring is compressed and the corresponding torsional force which must be exerted through the head to effect rocking of the cam means within the wrench.

Though the basic idea of means embodied in the above noted adjusting means and related indicating means appears simple and such that one exercising ordinary skill might provide structure which is suitable to reduce that idea of means to practice, the contrary has proven to be the case.

Due to the fact that the adjusting screws in wrenches of the type here concerned with occur within the rear portions of the lever arms which must be gripped by the operators of the wrenches, accessibility to the screws is generally restricted to the rear terminal ends of the lever arms. Since the screws must be shifted axially to a substantial extent to effect necessary adjustment, they would, in the absence of rather complicated, non-obvious means project substantial distances rearward from the lever arms and create most undesirable and objectionable obstructions. Further, should the adjusting screws project freely rearwardly from the lever arms, the establishing and/or provision of a simple, durable and effective indicating means is not easily and simply satisfied.

In the prior art, the adjusting screws of wrenches of the type here concerned with have been provided with operating knobs which occur rearward of the rear ends of the lever arms and which carry calibrated sleeves which surround portions of the screws and which telescopically enter the rear ends of the arms. With such structures, the axial positioning of the screws and resulting set operating force of the wrenches can be readily ascertained. The principal shortcoming to be found in the above type of operating and indicating means resides in the fact that the operating knobs are exposed, creating obstructions and are readily inadvertently moved to upset adjustment of the wrenches in the normal course of using the wrenches. Additionally, the calibrated indicating means in such structures are exposed to the elements of the environment in which such wrenches are commonly used and are frequently mutilated, abraded and/or obscured by dirt, grease and the like. The above noted shortcomings are of sufficient moment that wrenches so constructed are considered unacceptable by many users of adjustable click-type torque wrenches.

Another prior art click-type adjustable torque wrench having manually operable adjusting means and related calibrated indicating means is disclosed in my U.S. Pat. No. 3,772,942 for "ADJUSTABLE TORQUE WRENCH", issued Nov. 20, 1973. In that patented wrench construction, the rear end of the lever arm slidably carries an elongate hand-grip. The grip is such that when it is moved to a forward position, it establishes rotary driving engagement with the lever arm of the wrench and is out of rotary driving engagement with the adjusting screw of the wrench. The forward portion of the hand-grip normally overlies and protects force indicating calibrations provided on the exterior of the lever arm. This structure is such that when the handgrip is slid or moved rearwardly relative to the lever arm to a rear position, the calibrations on the lever arm are suitably exposed, rotary driving engagement between the arm and the grip is broken and rotary driving engagement with and between the grip and the adjusting screw is established, whereby adjusting of the wrench can be readily effected.

While the wrench described in my U.S. Pat. No. 3,772,942, and briefly described above, satisfied the need and often expressed demand for an adjustable type torque wrench wherein the adjusting means does not normally project rearwardly from the lever arm, in an exposed and vulnerable manner; and, a wrench wherein the calibrations of the indicating means are normally obscured and protected, it has been found to be wanting and less than totally satisfactory since the hand-grip, which is shiftably carried by the lever arm, is subject to sliding or shifting axially rearward to a position where it is out of rotating driving engagement with the lever arm and is in rotary driving engagement with the adjusting screw, during normal use of the wrench. Since the entire hand-grip is shiftable, it frequently moves out of normal position before the operator is aware of such shifting. When this happens, and rotary driving engagement with the arm is interrupted, the operator is likely to lose his grip on the wrench. Further, when the hand-grip inadvertently moves rearwardly and outwardly as torque is being applied to a related piece of work through the wrench by laterally applied forces on the grip, the portion of the grip unsupported by the lever arm is subject to being bent and deformed to an extent that the structure is rendered inoperable or incapable of free and/or proper subsequent operation.

Another major shortcoming of the above noted patented wrench construction resides in the fact that the interior of the rear end portion of the lever arm must be broached to establish spline receiving grooves which constitute parts of the releasable rotary drive means between the hand-grip and the lever arm. The noted spline receiving grooves require that the wall thickness of the lever arm be greater than is otherwise required. The use of excessively thick walled tube stock to establish the lever arm adds substantially to the cost and weight of the resulting wrench. The cost of broaching and establishing the spline receiving grooves in the arms is a costly operation which also adds to the cost of subject prior art wrenches.

The noted spline and groove typ rotary drive means between the lever arm and hand-grip of the above noted prior art structure, due to spacial limitations, is difficult and costly to establish. Additionally, since the above noted drive means is wholly within the tubular lever arm, it is excessively small in diametric extent and is such that its adequacy to withstand anticipated maximum applied rotary driving forces is considered marginal.

An object and feature of my present invention is to provide an adjustable click-type torque wrench of the general character referred to in the foregoing having novel operating or adjusting means with related calibrated indicating means.

It is an object and feature of this invention to provide a wrench of the character referred to above including an elongate tubular lever arm with an open rear end, an elongate adjusting screw arranged centrally within the arm and having a polygonal drive member or part at its rear end portion within the arm, an elongate tubular drive sleeve slidably engaged within the rear end portion of the lever arm and about the drive member and having a polygonal opening in its forward portion shiftable into and out of rotary driving engagement with the drive member, an elongate tubular hand-grip having a front section engaged about and fixed to the rear portion of the lever arm and a rear section fixed to the rear end of the drive sleeve and shiftable axially therewith. The rear end of the front section and front end of the rear section of the grip have releasably rotary drive coupling means related thereto.

The drive sleeve has axially spaced calibrations about its exterior which are normally within the arm and obscured from view, but which becomes exposed and visible when the drive sleeve is moved for a normal forward position in the arm to an actuated rear position. The rear end of the lever arm has circumferentially spaced calibrations which cooperate with the calibrations on the drive sleeve when the drive sleeve is in its rear or actuated position.

It is an object and feature of the present invention to provide a wrench structure of the character referred to above wherein the rear section of the handgrip normally overlies, obscures and protects the calibrations on the rear end of the lever arm and wherein said drive member is normally within the rear end portion of the lever arm whereby the calibrations thereon are obscured and protected.

It is another object and feature of this invention to provide a structure of the character referred to wherein the front section of the hand grip, engaged about and fixed to the rear portion of the lever arm, extends throughout the major longitudinal extent of the hand-grip normally engaged by the hand of an operator of the wrench and wherein the rear section of the grip is a short section in the nature of a finial at the rear end of the front section.

Another object and feature of this invention is to provide a structure of the character referred to wherein the rotary drive coupling means includes a large diameter annular series of circumferentially spaced axially extending splines on one section of the hand-grip and an annular series of axially extending grooves in the other section of the hand-grip to slidably receive the splines when the rear section is in a forward normal position and disengaged from said splines when the rear section is in a rear or actuated position.

It is another object and feature of the present invention to provide a structure of the character referred to above which includes novel means for releasably retaining the rear section of the grip in its forward normal position.

The foregoing and other objects and features of the present invention will be fully understood and will be apparent from the following detailed description of one typical preferred form and carrying out of the invention, throughout which description reference is made to the accompanying drawings, in which.

Figures 1, 2, 3, 4:
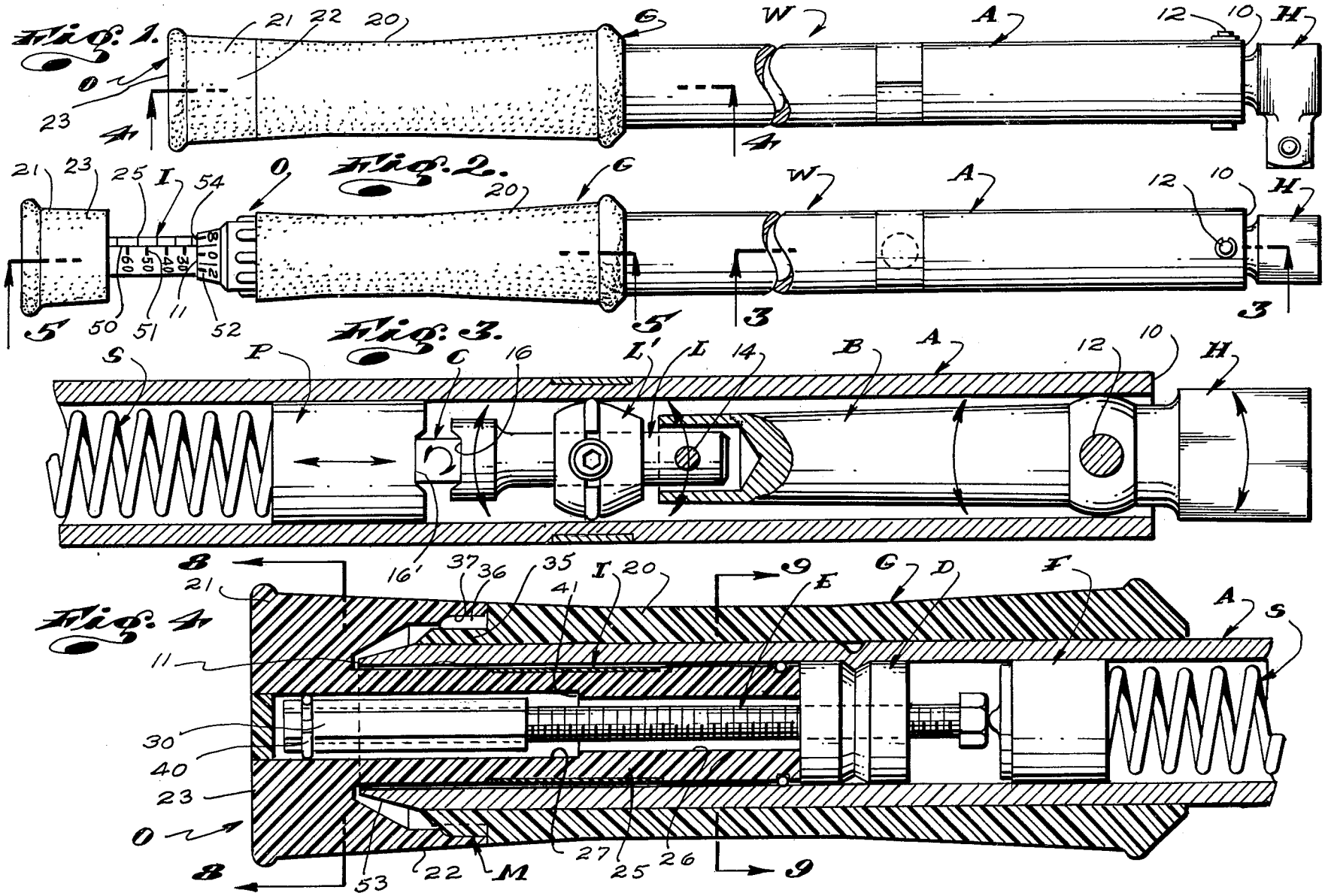
FIG. 1 is a side elevational view showing one side of the wrench.
FIG. 2 is an elongate view of another side of the wrench and showing parts in another position.
FIG. 3 is an enlarged detailed sectional view taken substantially as indicated by line 3—3 on FIG. 2.
FIG. 4 is an enlarged detailed sectional view taken substantially as indicated by line 4—4 on FIG. 1.

The wrench W shown throughout the drawings is an adjustable click-type torque wrench and in many respects is similar to that wrench which is disclosed in my above identified U.S. Pat. No. 3,772,942 and includes several important and novel improvements.

The wrench W includes an elongated tubular lever arm A with front and rear ends 10 and 11. The wrench next includes a work engaging head H which is positioned adjacent the front end 10 of the arm A. The head H carries an elongate pivot beam B which projects rearwardly therefrom and into the forward portion of the arm A to normally occur in central longitudinal alignment therein. The forward end portion of the beam is pivoted to the forward end of the arm A by a pivot pin 12 so that upon lateral displacement of the head H relative to the forward end of the arm A, the beam will pivot about the axis of the pin and the rear end of the beam will swing laterally within the arm and will engage or strike the interior surface of the arm. An elongate axially extending link L is arranged in the arm A rearward of the beam B. The forward end of the link L is pivoted to the rear end of the beam B by a pin 14. The central portion of the link L carries and is pivotally supported in the arm A by a fulcrum L' which is in the nature of a semi-spherical or conical block with a peripheral groove in which a bearing part inthe form of a snap-ring is engaged.

The rear end of the link L has a flat rearwardly disposed pivot block seat 16. An elongate cylindrical plunger P with front and rear ends is slidably engaged within the arm A rearward of the link L. The front end of the plunger P has a cam block seat 16' spaced from and opposing the seat 16. A cam block C with flat normally forwardly and rearwardly disposed faces is arranged between the link L and plunger P with its faces normally establishing flat bearing engagement on and with the seats 16 and 16'. An elongate compression springS is arranged within the arm A rearward of the plunger P with its front end seated on and bearing against the rear end of the plunger. A follower block is slidably engaged within the arm rearward of the spring and engages the rear end of the spring. A plug D, with a central threaded opening, is fixed in the arm A in rearward spaced relationship from the follower block F. An elongate, central adjusting screw E with front and rear ends is engaged through the plug D. The front end of the screw E engages the follower block F and the rear end of the screw is accessible at or through the open rear end of the arm A.

By advancing the screw E longitudinally forwardly or rearwardly through the plug D, the extent to which the spring S is biased or compressed axially between the block F and the plunger P and the resulting force exerted on the cam block C between the plunger P and link L can be adjusted.

The wrench structure thus far described is well known in the art and is substantially the same both structurally and functionally with corresponding parts and portions of that wrench construction which is disclosed in my above identified U.S. Pat. No. 3,772,942.

As regards the present invention, the pertinent and significant parts and/or portions of the structure thus far described is the rearwardly opening rear end portion of the lever arm A and the rear end portion of the elongate axially movable adjusting screw E which is centrally located in and extends longitudinally through the rear end portion of the arm A. All other structure and details of the construction thus far described can be varied considerably without departing from the spirit of or affecting the novelty of the present invention.

The present invention next includes novel adjusting screw operating means O. The means O includes an elongate sectional tubular hand-grip G. The grip G has an elongate cylindrical, tubular front section 20 slidably engaged about and fixed to a rear end portion of the arm A. The section 20 can be cast of metal or molded of a suitable plastic and is preferably fixed on and about the arm A by a suitable epoxy cement or the like.

The grip G next includes an elongate cap-like rear section 21 which has an annular forwardly projecting skirt portion 22 normally engaged with the rear end of the forward or front section 20 and has a rear portion 23 which normally overlies the open rear end 11 of the arm A, as will hereinafter be described.

The operating means O next includes an elongate cylindrical tubular drive sleeve 25 integrally joined with and projecting forwardly from the rear portion 23 of the rear section 21 of the grip G. The sleeve 25 enters in the rear end portion of the arm A to occur about the rear end portion of the screw E which extends centrally through the rear portion of the arm A. The drive sleeve 25 has a central longitudinal opening with a forward polygonal portion 26 and an enlarged cylindrical rear portion 27.

The screw E is provided with and carries an elongate polygonal driver 30. The driver 30 is on and about the rear end of the screw E and normally occurs in the rear cylindrical portion 27 of the opening in the drive sleeve 25, as clearly shown in FIG. 4 of the drawings.

Figure 5:
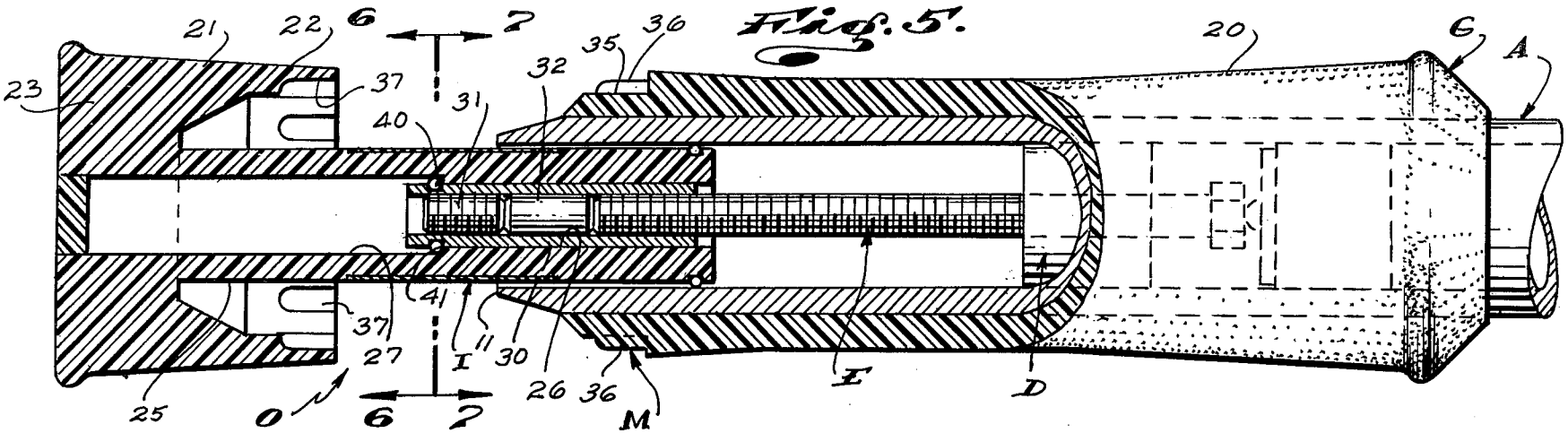
FIG. 5 is an enlarged detailed sectional view taken substantially as indicated by line 5—5 on FIG. 2.
Figure 9:
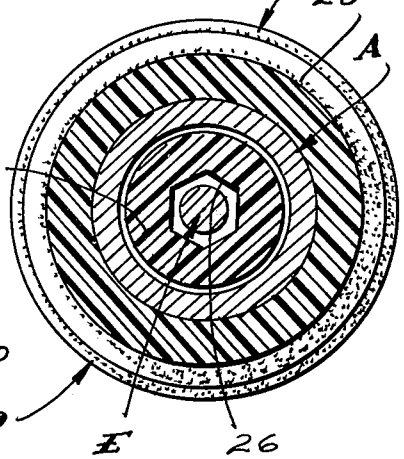
FIG. 9 is a sectional view taken as indicated by line 9—9 on FIG. 4.
Figure 8:
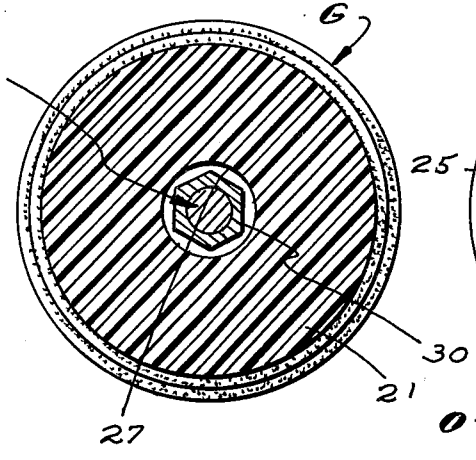
FIG. 8 is a sectional view taken as indicated by line 8—8 on FIG. 4.
Figure 7:
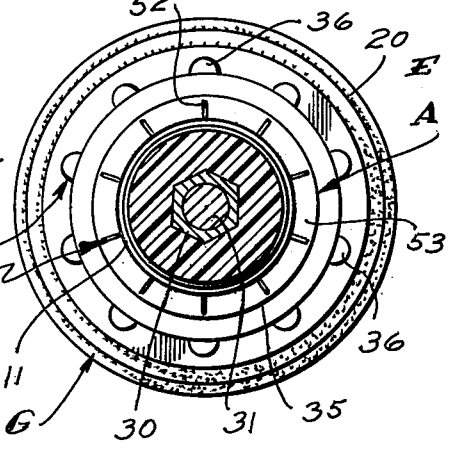
FIG. 7 is a sectional view taken as indicated by line 7—7 on FIG. 5.
Figure 6:
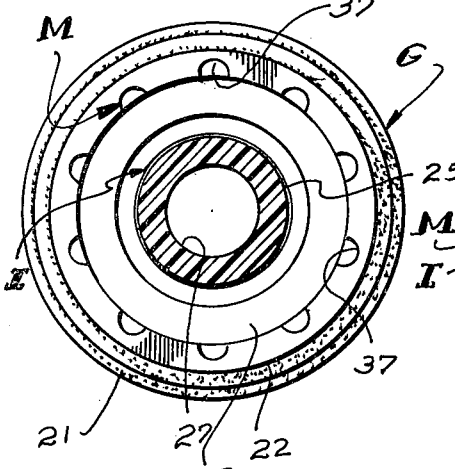
FIG. 6 is a sectional view taken as indicated by line 6—6 on FIG. 5.

The polygonal driver 30 is such that when the drive sleeve 25 is moved rearwardly from a normal forward position to an actuated rear position, it slidably enters the polygonal forward portion 26 of the opening in the sleeve and establishes rotary driving engagement therewith, as clearly shown in FIG. 5 of the drawings.

In practice, and as shown in FIG. 5 of the drawings, the driver 30 is an elongate, tubular, internally threaded part engaged on and about the rear portion of the screw E whereby its axial position on the screw can be adjusted as desired or as circumstances require. The driver is set in adjusted position on the screw by means of a suitable set screws 31 and spacer 32, within the rear portion of the driver and engaging the rear end of the screw.

With the structure of the means O thus far described, it will be apparent that when the rear section 21 of the grip G is in its normal forward position, the sleeve 25 carried thereby is in its forward normal position where the polygonal driver 30 on the screw E occurs within the rear cylindrical portion 27 of the opening in the sleeve and where free relative rotation of the sleeve 25 and driver 30 is afforded. When the section 21 of the grip G is moved rearwardly to its rear or actuated position, the sleeve 25 is moved rearwardly to its actuated position therewith and the forward polygonal portion 26 of the opening therein is moved into rotary driving engagement with the polygonal driver 30 on the screw, as clearly shown in FIG. 5 of the drawings.

When the parts of the construction are in their normal position, shown in FIG. 4 of the drawings, the rear section 21 of the grip and the sleeve 25 cannot turn. When the parts of the construction are in their rear or actuated position, shown in FIG. 5 of the drawings, the section 21 and sleeve 25 rotatable and the screw E is rotated or driven upon manual rotation or turning of the rear section 21 of the grip G.

The means O next includes releasable locking means M to lock the rear section 21 of the grip G against rotation relative to the forward section 20 of the grip when the rear section of the grip is in its forward normal position and to allow for free rotation of the rear section of the grip when that section of the grip is moved rearwardly to its actuated position. The means M includes a cylindrical extension 35, of reduced diameter, projecting forwardly from the rear end of the front section 20 of the grip and freely or slidably engageable in the forward annular skirt portion 22 of the rear section 21 of the grip, when that section of the grip is in its forward normal position, as shown in FIG. 4 of the drawings.

The means M next includes an annular series of radially outwardly projecting, elongate, axially extending splines 36 on and about the exterior of the extension 35 and an annular series of radially inwardly and axially forwardly opening elongate, axially extending grooves 37 in the skirt portion 22 of the grip section 21 and slidably receiving the splines 36 when the section 21 is in its normal forward position.

It is to be particularly noted that the annular series of splines 36 and grooves 37 are in a pattern of large diametric extent and are on, exposed and within readily accessible parts and portions of the construction. Accordingly, the splines and grooves can be easily and conveniently established and can be made sufficiently large, dimensionally, so that the means M is extremely rugged and durable. Further, the size and location of the means M is such that it is not subject to excessive wear or distortion and is such that, if necessary, it can be easily and conveniently cleaned and serviced when circumstances require.

Another important feature of the means M is that it operates as an indexing means to stop and retain the grip section 21 and its related screw E in predetermined rotative positions relative to the section 20 of the grip and the arm. In the preferred carrying out of the invention, there are 10 splines and 10 grooves whereby the noted structure can be set and locked in 10 relative rotative positions.

The means O that I provide next includes stop means to limit rearward movement of the drive sleeve 25 and to stop said sleeve in a predetermined actuated position relative to the driver and to the scre when the construction is moved from its normal forward position to its rear actuated position.

The stop means includes a radially outwardly projecting annular stop 40 on and about the rear end portion of the polygonal driver 30 and an annular rearwardly disposed stop shoulder 41 within the sleeve 25 and defined by the junction of the small diameter front and large diameter rear portions 26 and 27 of the opening in the sleeve 25. The stop 40 can, as shown, be established by a snap ring engaged in an annular grooves established in and about the rear portion of the driver. With the stop means illustrated and described above, it will be apparent that when the sleeve 25 is moved axially rearwardly to its actuated position, the stop 40 engages the shoulder 41 and stops the sleeve in a predetermined position relative to the driver 30 and the screw E.

The means O next includes retaining means to releasably hold or retain the sleeve 25 and the rear section 21 of the grip G in their normal forward positions. The retaining means can vary widely in form and in the case illustrated, includes a radially outwardly opening annular groove in and about the forward portion of the sleeve 25 and a resilient snap ring 44 engaged in the groove to project radially therefrom and establish pressure engagement with the interior of the arm and thereby functionally hold the sleeve in manually set axial position relative to the arm.

The means O that I provide next and finally includes novel indicating means I which accurately indicates the axial positioning of the screw E relative to the arm and the resulting extent to which the spring S is compressed between the follower F and the plunger P and the corresponding set force of the wrench construction. The indicating means I includes a longitudinally extending reference line 50 and a plurality of longitudinally spaced calibrations 51 on and about the exterior of the drive sleeve 25. The calibrations are on that portion of the sleeve which is or can be exposed when the construction is in its rear or actuated position and are therefore clearly visible, as illustrated in FIG. 2 of the drawings.

It is to be noted that when the construction is in its normal position, the calibrations on the sleeve are obscured by and are fully protected within the construction, as shown in FIG. 1 of the drawings.

In practice, the calibrations are printed on a metal foil label and fixed to the sleeve by a pressure adhesive. To better project the label against wear, the exterior of the drive sleeve is machined to provide a relieved portion to receive the label, with its outer surface slightly recessed radially inward of the outside surface of the remainder of the sleeve.

The means I next includes a series of circumferentially spaced calibrations 52, including a base or zero ()) calibration about the exterior of a radially inwardly and axially rearwardly inclined surface 53 on the rear end portion of the arm A. The width of the annular rear end 11 of the arm is reduced by the establishment of the surface 53 and establishes a reference line or edge to be cooperatively related to the calibrations 51. The portion of the arm with the calibrations 52 thereon, normally projects into the recess defined by the forward skirt portion 22 of the section 21 of the grip G and is fully exposed for convenient reading of the calibrations thereon when the structure is in its rear actuated position.

The calibrations 51 on the driver sleeve are spaced axially apart a distance corresponding to the feed or axial movement of the sleeve and the screw E effected by one revolution of the screw and indicate, by means of reference numerals related thereto, the operating force of the wrench construction which is attained when each calibration 51 is aligned with the annular reference edge 11 established by the rear end of the arm (when the drive sleeve is in its rear actuated position). The calibrations 52 on the surface 53 of the arm A are spaced to indicate predetermined portions of one revolution of the drive sleeve and screw and are alignable with the longitudinal reference line 50 on the sleeve. The base or zero calibration of the calibrations 52 aligns with the reference line 50 on the sleeve when the edge or line 54 is aligned or in register with each calibration 51.

The calibrations 52 are equal in number with and are substantially aligned with the splines and grooves of the means M. Accordingly, the means M can only be made up; that is, the grooves and splines can only be engaged when one of the calibrations 52 is aligned with the reference line 50. In the case illustrated, wherein the means M includes 10 splines and grooves, the construction can be adjusted and set in 10ths of revolutions.

With the indicating means I, set forth above, the operating force effected by each full revolution of the sleeve 25 and screw E and/or turning of the sleeve and screw through predetermined portions of one revolution, can be and is accurately indicated.

With the means set forth above, and by providing a proper spring in the construction, one full revolution of the sleeve 25 and screw S can, for example, effect a change in operative force of 10 foot pounds and rotation of the sleeve and screw from one calibration 52 to the next effects a change in operation force of 1 foot pound.

Further, the indicating means I is such that it is normally covered and protected against the elements of the environment in which the wrench is used and yet is fully visible and easy to view and read when circumstances require.

Having described only one typical preferred form and embodiment of my invention, I do not wish to be limited to the specific details herein set forth, but wish to reserve to myself any modifications and/or variations that may appear to those skilled in the art and which fall within the scope of the following claims Having described my invention, I claim:

1. An adjustable torque wrench including an elongate, tubular lever arm with front and rear ends, a work-engaging head carried by the front end of said arm and means within the arm and coupled with the head to transmit a signal when a predetermined operating force is applied through the arm and head into work engaged with the head; said signalling means includes an elongate adjusting screw within the rear portion of the arm and shiftable longitudinally therein upon rotation thereof to adjust said operating force; and, operating means for said adjusting screw including a polygonal driver on the screw, an elongate drive sleeve with front and rear ends shiftable axially forward to a normal position substantially wholly within the arm and shiftable axially rearwardly to an actuated position where it projects from the arm, said sleeve has a polygonal opening in which said driver is slidably engaged when the sleeve is in its actuated position and an enlarged opening in which the driver is normally positioned, an elongate hand-grip including a rear section at the rear end of the sleeve to normally occur adjacent the rear end of the arm and having a forwardly projecting skirt portion normally surrounding the rear end portion of the arm, a tubular front section in fixed engagement about the rear portion of the arm forward of said skirt portion when the rear section is in its normal position, that portion of the sleeve which projects rearwardly from the arm when the sleeve is in its actuated position has longitudinally spaced calibrations corresponding with predetermined axial positions of the screw within the arm, said rear end of the arm defines a reference line for said longitudinally spaced calibrations on the sleeve, and means to releasably lock the rear section of the grip against rotation relative to the front section thereof when the rear section is in its normal position and including an extension projecting rearwardly from the front section and normally projecting into said skirt, radially inwardly and axially forwardly opening grooves in the annular skirt and longitudinally extending radially outwardly projecting splines on said extension and normally engaged in the grooves.

2. The wrench set forth in Claim 1 which further includes top means to stop the sleeve in its rear actuated position, said stop means including a rearwardly disposed shoulder within the sleeve and a radially outwardly projecting stop on the driver and engageable with said shoulder.

3. The wrench set forth in claim 1 which further includes retaining means releasably retaining the sleeve in its normal position and including an annular groove about the sleeve and a resilient snap ring engaged and retained in said groove and frictionally engaging the interior of the arm.

4. The wrench set forth in claim 2 which further includes retaining means releasably retaining the sleeve in its normal position and including an annular groove about the sleeve and a resilient snap ring engaged and retained in said groove and frictionally engaging the interior of the arm.

* * * * *